US006755558B2

(12) United States Patent
Krietenstein et al.

(10) Patent No.: US 6,755,558 B2
(45) Date of Patent: Jun. 29, 2004

(54) LUMINAIRE, IN PARTICULAR RECESSED LUMINAIRE

(75) Inventors: Beate Krietenstein, Detmold (DE); Karl-Heinz Holzkämper, Lemgo (DE)

(73) Assignee: Zumtobel Staff GmbH & Co. KG, Lemgo (DE)

( * ) Notice: Subject to any disclaimer, the term of this patent is extended or adjusted under 35 U.S.C. 154(b) by 92 days.

(21) Appl. No.: 10/244,471

(22) Filed: Sep. 17, 2002

(65) Prior Publication Data

US 2003/0063471 A1 Apr. 3, 2003

Related U.S. Application Data

(63) Continuation of application No. PCT/EP01/01904, filed on Feb. 20, 2001.

(30) Foreign Application Priority Data

Mar. 17, 2000 (DE) ..... 200 04 985 U

(51) Int. Cl.[7] ..... F21V 15/00

(52) U.S. Cl. ..... 362/365; 362/368; 362/235; 362/378

(58) Field of Search ..... 362/365, 368, 362/235, 404, 364, 147, 378

(56) References Cited

U.S. PATENT DOCUMENTS

| | | | | |
|---|---|---|---|---|
| 4,763,231 | A | 8/1988 | Houplain | 362/148 |
| 5,931,567 | A | 8/1999 | Salzmann et al. | 362/304 |
| 6,155,693 | A | 12/2000 | Spiegel et al. | 362/147 |

FOREIGN PATENT DOCUMENTS

| | | | |
|---|---|---|---|
| DE | 3940437 | A1 | 6/1990 |
| DE | 4344376 | A1 | 6/1995 |
| DE | 4344431 | A1 | 8/1995 |
| EP | 0686805 | A1 | 12/1995 |
| WO | WO 98/03817 | A | 1/1998 |

*Primary Examiner*—Sandra O'Shea
*Assistant Examiner*—Guiyoung Lee
(74) *Attorney, Agent, or Firm*—Fitzpatrick, Cella, Harper & Scinto

(57) ABSTRACT

A recessable luminaire (1) having a dome-shaped reflector (5), a lead-through hole (18) in a reflector side wall (14) and a light source carrier (6) carrying a light source (7), the light source carrier (6) being located at least partially outside the reflector (5) and the lead-through hole (18) being passed through by the light source carrier (6) or the light source (7) in such a manner that at least the light source (7) is located within the reflector (5). For simplification of the luminaire, the light carrier (6) is attached to the reflector (5) by means of direct connection with the outer side of the reflector (5).

8 Claims, 2 Drawing Sheets

LUMINAIRE, IN PARTICULAR RECESSED LUMINAIRE

CROSS REFERENCE TO RELATED APPLICATIONS

This is a Continuation of International Application PCT/EP01/01904 filed Feb. 20, 2001 which in turn claims priority of German application DE 200 04 985.2, filed Mar. 17, 2000, the priorities of which are hereby claimed, said International Application having been published in German, but not in English, as WO 69127 A1 on Sep. 20, 2001

BACKGROUND OF THE INVENTION

1. Field of the Invention

The invention relates to luminaries and more particularly, it concerns a novel recessable luminaire with a novel quick-fastening or plug-in connection.

2. Description of the Related Art

Common luminaries for the illumination of a room can be divided in two categories with regard to their disposition with respect to a carrier carrying them. With the first category, the luminaire, together with a housing which may be present and receives the reflector, is mounted on a luminaire carrier, for example on the ceiling or a wall of the room, or on a luminaire carrier arranged in the room. Thereby, the luminaire may be mounted as a surface-mount luminaire directly on the luminaire carrier or at a spacing therefrom, for example by means of least one elongate suspending element, such as one or more cables, chains or pendants. With the second category the luminaire is, as recessed luminaire, at least partly recessed into an installation opening in the luminaire carrier, for example in the ceiling or wall of the room.

A luminaire of the kind indicated in the introduction is described for example in DE 43 44 376 A1 or DE 43 44 431 A1, in each case as recessed luminaire. With these known configurations, the reflector is in each case fastenable to the luminaire carrier, namely the ceiling of a room, by means of a base frame, whereby the base frame has at its end towards the emission direction a flange-like edge part for covering the joint between the installation opening edge. The base frame can be attached by means of special mounting parts to the edge of the installation opening and thus forms a first mounting means for mounting the luminaire on the luminaire carrier. A lamp holder or fitting carrier for at least one lamp is arranged in a position in which it lies outwardly opposite a recess in the reflector and is releasably connectable with the base frame by second mounting means. With this known configuration a great production outlay is unavoidable, and it also leads to mounting or de-mounting which involves complex manipulation and is time consuming.

SUMMARY OF THE INVENTION

An object of the invention is to simplify a luminaire of the kind indicated in the introduction. In particular, the mounting of the lamp holder is to be improved.

This object is achieved by means, of a novel plug-in connection for attaching a light source carrier to a luminaire reflector. The connection comprises guide parts on the reflector and on the light source carrier which engage in a form-fitting manner and which define a plug-in direction which is approximately in a main emission direction of the luminaire.

With the configuration in accordance with the invention, the lamp holder is attached on the reflector by means of direct connection with the outer side of the reflector. By these means it is possible to mount the fitting carrier directly on the outer side of the reflector. In comparison with the typical configuration, a base frame as intermediate mounting part between the fitting carrier and the reflector can be omitted. Consequently, the luminaries in accordance with the invention can be configured more simply, whereby production outlay, material, weight, outlay for mounting and de-mounting and costs can be saved and a compact manner of construction can be attained.

Additional features are also described and claimed herein which further simplify the manner of construction and production, and further facilitate the mounting or de-mounting. Thereby it is possible to attach the lamp holder non-releasably on the reflector. In the first case it is advantageous to form the lamp holder in one piece on the reflector. Through this, both parts can be produced in one working step, whereby in this regard mounting or de-mounting measures are no longer needed. By means of a releasable attachment of the lamp holder, a bulky structure of the reflector can be avoided. In this case it is advantageous to arrange between the reflector and the lamp holder a quick-fastening connection, preferably a plug-in connection, through which a ready and rapid mounting or de-mounting is ensured. It is for example possible at the installation site, to mount or to de-mount the lamp holder in a simple manner, as far as possible without the use of tools, on the reflector. Thereby it is further advantageous to so configure the plug-in connection that the plug-in movement of the lamp holder into the plugged-in position is directed approximately vertically or downwardly. With such a configuration, due to its weight, the lamp holder is prevented from moving out of the plug-in fitting. In cases in which the plug-in movement, taking into account the installation circumstances of the luminaire, is not downwardly directed, it is advantageous to provide between the reflector and the lamp holder a positioning device for the releasable positioning of the lamp holder in the plugged-in position in order to avoid unintended movements of the lamp holder out of its plugged-in position. Such a positioning device is suited for all installation dispositions, and also then if the plug-in movement of the lamp holder is not downwardly directed. By these means there is for example avoided that the lamp holder is moved out of its plugged-in position due to mounting or de-mounting measures, for example upon the plugging-in of a lamp into a fitting of the lamp holder. Further, features are attained which lead to a small and/or economically producible construction of the luminaire or of its parts.

BRIEF DESCRIPTION OF THE DRAWINGS

Below, the invention and further advantages which can be achieved thereby will be explained in more detail with reference to preferred configurations of an exemplary embodiment and to simplified drawings.

DETAILED DESCRIPTION OF THE PREFERRED EMBODIMENT

Figure 1:
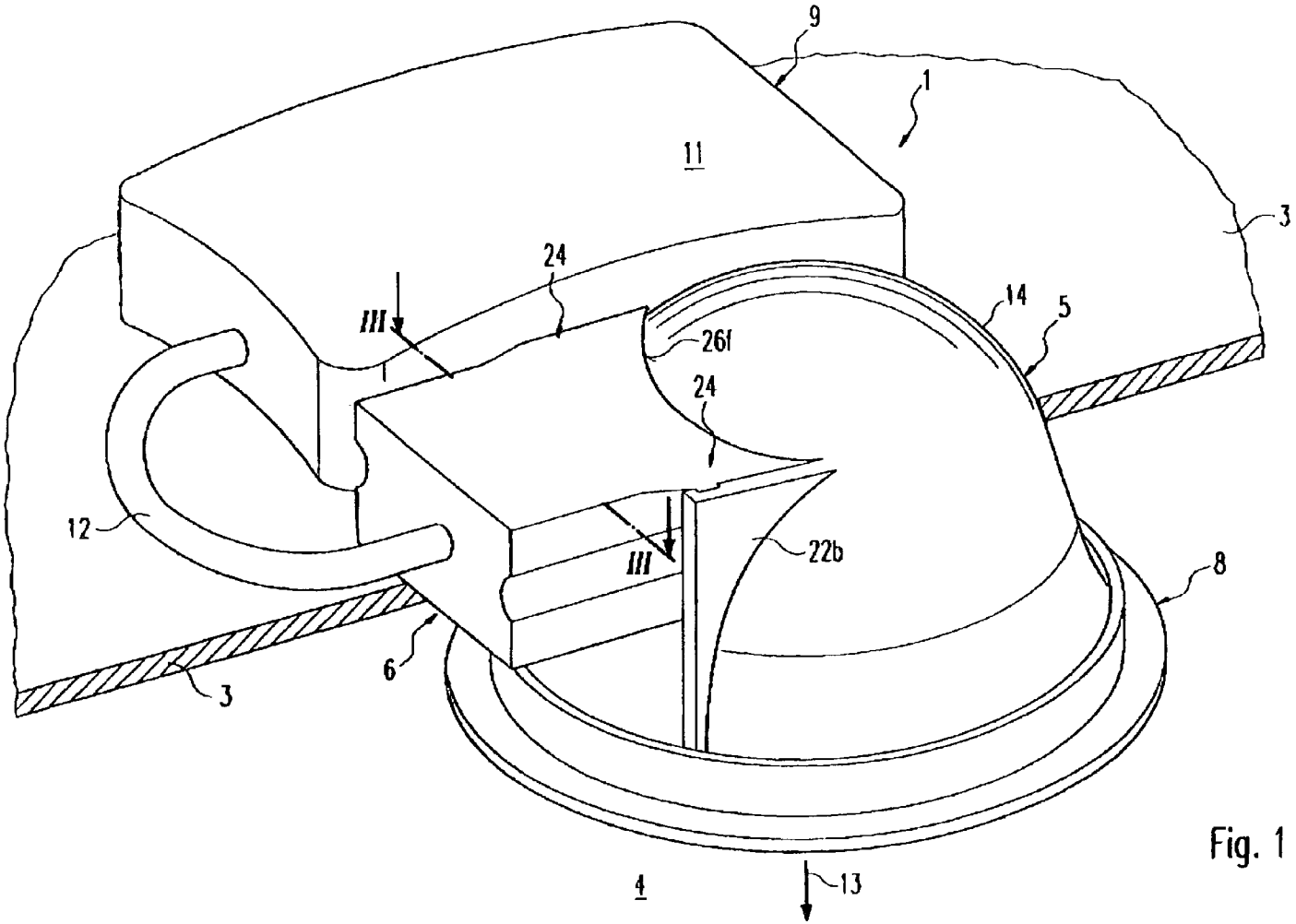
FIG. 1 is a perspective view showing a luminaire in accordance with the invention in mounted position.
Figure 2:
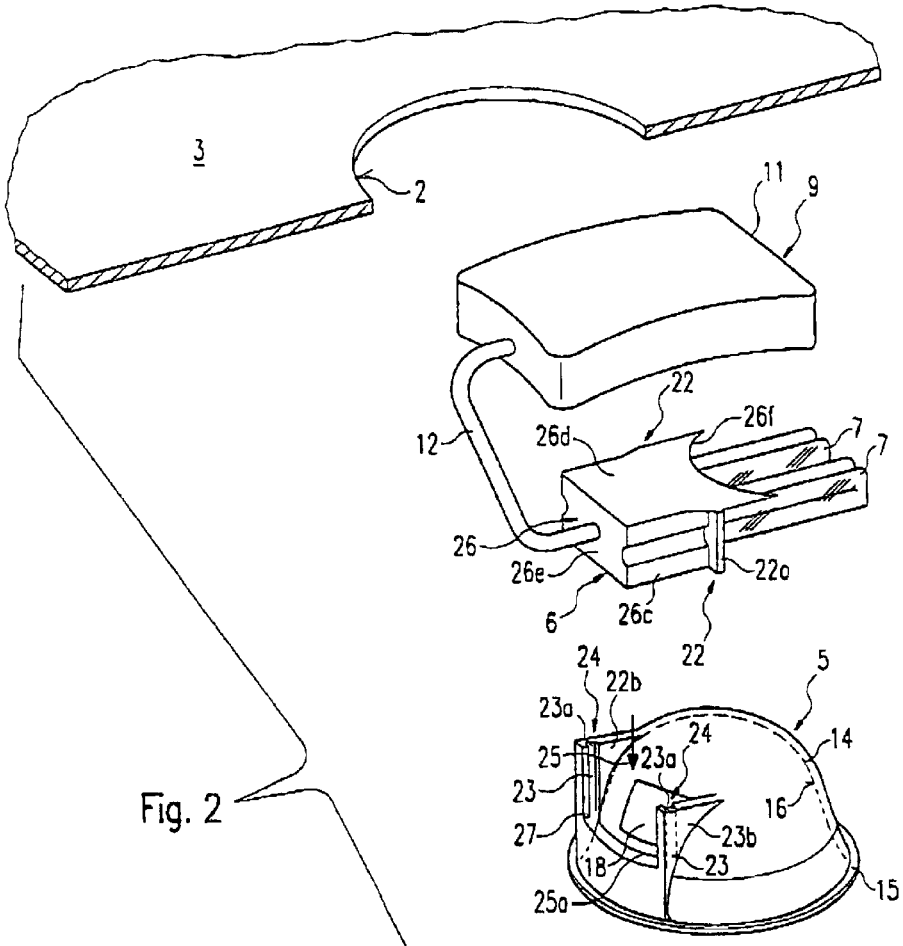
FIG. 2 is an exploded perspective view of the luminaire shown in FIG. 1.

The luminaire, designated in its entirety by 1, is a recessed luminaire which is installed in an installation opening 2 of an installation wall 3, which may be a ceiling or a wall of a room 4 to be illuminated with the luminaire 1. For this purpose there serve non-illustrated first mounting means, which cooperate with the edge of the installation opening.

The main parts of the luminaire 1 are a dome-shaped reflector 5 and a light source carrier for receiving at least one light source. For reasons of simplification, in the further description with regard to the exemplary embodiment, the light source carrier will be designated fitting carrier 6 and the light source will be designated lamp 7, which may be at least one fluorescent lamp. Further, there are provided a mounting ring 8 for covering over an installation gap between the luminaire 1 and the edge of the installation opening 2 and operating means 9 for the luminaire, which may be for example a ballast and/or electrical connection elements, which for example may be arranged in an operating means housing 11 and which are connected or connectable by means of an electric cable 12 with the fitting carrier 6.

With the present exemplary embodiment, the luminaire 1 or its reflector 5 has a round cross-sectional form, whereby the cross-section runs at right angles to the main emission direction 13 extending into the room 4. The invention is, however, not restricted to a round cross-section form. Within the scope of the invention, the cross-sectional form may also deviate from a round form, for example a quadrilateral or quadratic cross-sectional form. The reflector 5 consists of a dome-shaped reflector wall 14 having a circumferential wall section diverging in the main emission direction 13, which transitions into a domed ceiling wall section. An outer flange 15 may be formed at the edge of the circumferential wall section. The inner surface of the circumferential wall section and of the ceiling wall section is formed as a reflection surface 16. For this purpose, the relevant inner surface of the reflector wall 14 may be appropriately treated or coated with a reflection layer. For positioning the lamp 7, preferably in the upper region of the inner space 17 of the reflector 5, there is provided in the circumferential wall section of the reflector wall 14 a lead-through hole 18, which in the case of the present exemplary embodiment has a substantially quadrilateral form.

The mounting ring 8 is formed, in cross-section, in an angled manner, with a sleeve limb 8*a* extending coaxially to its middle axis and a flange limb 8*b* projecting outwardly therefrom. The mounting ring 8 may have attachment means, still to be described, with which it is releasably attachable to the free edge of the reflector 5 and/or to the edge of the installation opening 2. It is the purpose of the mounting ring 8 to cover over a gap which is present in the mounted position of the luminaire 1 between the edge of the installation opening 2 and the reflector 5. The mounting ring may have, arranged distributed around the circumference, and extending upwardly therefrom, non-illustrated mounting fingers, which for a releasable attachment to the installation opening edge releasably engage therebehind. Further, the mounting ring 8 may carry the reflector 5 and thus form a part of the already mentioned first mounting means for mounting the reflector 5 in the installation opening 2. It is also possible that the reflector 5 has, outwardly on its lower edge, mounting fingers projecting upwardly, for releasably engaging behind the installation opening edge.

The mounting ring 8 may also have on its inner surface an encircling inner flange 8*c* or a plurality of inner projections arranged distributed around the circumference, preferably formed in one piece with the ring.

The fitting carrier 6 is positionable directly on the reflector 5 by means of second mounting means 22 formed on the fitting carrier and third mounting means 23, corresponding to the second mounting means, which are arranged on the reflector to be externally accessible. The second and third mounting means 22, 23 form a quick-fastening connection, in particular a plug-in connection 24 which makes it possible to mount or to de-mount the fitting carrier 6 on the reflector 5 readily and quickly. The second mounting means 22 and/or its carrier parts are preferably formed in one piece on the fitting carrier 6. Correspondingly, the third mounting means 23 and/or its carrier parts are preferably also formed in one piece on the reflector 5. By these means a rational and economic production is possible. It is advantageous to so form the mounting means 22, 23 that they can be brought into mounting engagement by means of a movement of the fitting carrier 6 approximately in the main emission direction 13, and are releasable from one another by means of opposite movement of the fitting carrier 6. For this purpose there may serve a guide having at least one guide part, which is held in the guide displaceably up to an end position but form-fittingly held in the guide transversely of the guide.

Figure 3:
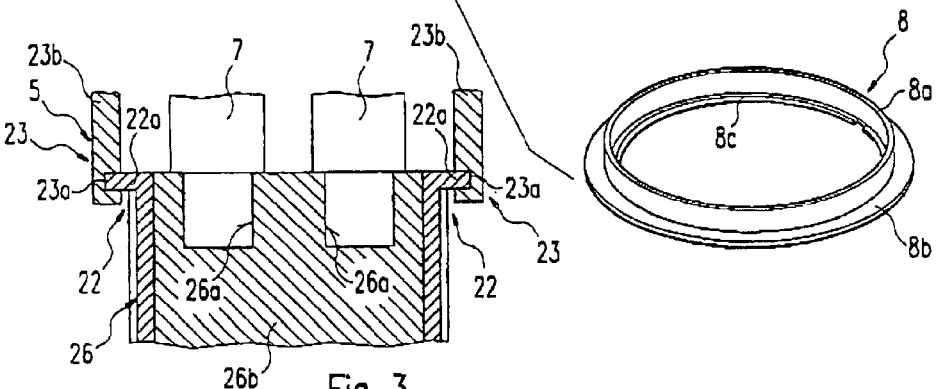
FIG. 3 is a fragmentary section view taken along the part section in the sectional plane III—III of FIG. 1.

With the present exemplary embodiment, the third mounting means 23 are formed by means of grooves 23*a*, arranged opposite one another, in web walls 23*b* arranged to the two sides of the lead-through hole 18, which web walls extend substantially parallel to one another and substantially parallel to the main emission direction 13 and are preferably attached in one piece on the reflector wall 14, preferably being formed thereon. The fitting carrier 6 has guide webs 22*a*, projecting away from one another, which fit into the guide grooves 23*a* with play for sliding. The plug-in movement, indicated by the arrow 25, may be bounded by the ends of the guide grooves 23*a* and/or by a step surface 25*a* on the reflector wall 14. The fitting carrier may have a block-shaped fitting housing 26, in which one or more fittings 26*a*—illustrated only in FIG. 3—are arranged in a fitting body 26*b* which are accessible from the end side of the housing 26 towards the reflector 5 with one or more lamps 7, in this case two lamps. In the Figures there can be seen the side walls 26*c* extending transversely of the open end side, a ceiling wall 26*d* and a rear wall 26*e* of the fitting housing 26. The ceiling wall 26*d* is preferably extended beyond the end side of the fitting housing 26, whereby its end edge 26*f* extends up to the circumferential wall section of the reflector 5 and is concavely formed corresponding to the shape of the reflector. By these means a free space provided above the lead-through hole 18, due to the divergence of the circumferential wall section, is covered over, whereby the extension of the ceiling wall 26*c* provides protection against the at least one fitting or lamp 7 being effected by dust.

The quick-fastening connection or plug-in connection 24 makes possible a ready and rapid mounting or de-mounting of the fitting carrier 6 on the reflector 5, namely by means of simply plugging-in of the second mounting means 22 into the third mounting means 23. This can be effected before the installation of the reflector 5 in the installation opening 2, whereby the reflector 5, pre-mounted to this extent, with the operating means housing and the fitting carrier 6, can be inserted in a tilted disposition into the installation opening and then tilted into its normal disposition. A possibility for positioning the reflector 5 on the installation wall 5 can—as described above—be effected by means of the mounting ring 8 or mounting means arranged on the reflector 5. It is of advantage to releasably position the fitting carrier 6 in its position plugged-in to the plug-in fitting 24 by means of at least one positioning element, preferably by means of a clamping or latching device, which are releasable or preferably can be manually overcome for their release. A clamping device can for example be formed in that in the end region of the plug-in fitting there is arranged to the side at least one clamping cam 27, which is in particular formed on, which jams the associated mounting means 22 in the plug-in end disposition and thus arrests it. Preferably, for release, this clamping can be manually overcome.

With all configurations, the mounting ring 8 can serve as carrier for the releasable attachment of accessory parts, for example for a plate covering the inner space 17 of the reflector 5. For reasons of simplification this is not illustrated.

The reflector 5, the fitting carrier 6 and/or the mounting ring 8 are preferably of a material that can be produced by injection molding or die casting, for example aluminum or plastics, whereby the parts are in each case formed in one piece with their attached parts and can be simply and economically produced by molding.

The lamps 7 can, after the mounting of the fitting carrier 6 on the reflector its inner space 17, i.e. placed into the fittings 26*a*.

What is claimed is:

1. A recessable ceiling or wall luminaire comprising:

a dome-shaped reflector having a lead-through hole in a side wall thereof;

a light source carrier carrying a light source, said light source carrier being located at least partially outside said reflector such that said lead-through hole is passed through by said light source carrier or by said light source in such a manner that at least said light source is located within said reflector, said light source carrier being attached to said reflector by means of direct connection with an outer side of said reflector; and a plug-in connection attaching said light source carrier to said reflector, said plug-in connection comprising guide parts on the light source carrier and on the reflector which interengage in a form-fitting manner, for realization of said plug-in connection, said guide parts being configured to define a plug-in direction which is approximately in a main emission direction of said luminaire.

2. A recessable luminaire according to claim 1, wherein said light source carrier is releasably attached to said reflector.

3. A recessable luminaire according to claim 1, wherein mutually engageable mounting means are formed on an outer side of said reflector and on said light source carrier.

4. A recessable luminaire according to claim 3, wherein the mounting means which is formed on said outer side of said reflector includes two projections located at both sides of said lead-through hole.

5. A recessable luminaire according to claim 1, wherein said guide parts are formed with spaced grooves and a web engaged therein.

6. A recessable luminaire according to claim 4, wherein said projections are formed with grooves directed towards one another into which there engage, with play for sliding, webs which project outwardly from the side walls on said lamp holder.

7. A recessable luminaire according to claim 1, and further including a positioning device for the releasable positioning of said fitting carrier in a position plugged-in to said plug-in connection.

8. A recessable luminaire according to claim 7, wherein said positioning device is a hatching device or a clamping device.

* * * * *